US007171954B2

(12) United States Patent
Oda et al.

(10) Patent No.: US 7,171,954 B2
(45) Date of Patent: Feb. 6, 2007

(54) FUEL VAPOR ADSORBING DEVICES

(75) Inventors: Kouichi Oda, Chita (JP); Minoru Honda, Kariya (JP); Yuushi Matsushita, Aichi-ken (JP); Koichi Hoshi, Susono (JP); Takaaki Itou, Mishima (JP); Toshiki Annoura, Nagoya (JP); Hideki Suzuki, Chiga-gun (JP); Futaba Kanehira, Nagoya (JP); Masahiro Mochizuki, Okazaki (JP)

(73) Assignees: Toyota Boshoku Kabushiki Kaisha, Aicha-Ken (JP); Toyota Jidosha Kabushiki Kaisha, Aicha-Ken (JP); Denso Corporation, Aicha-Ken (JP); Aisin Seiki Kabushiki Kaisha, Aicha-Ken (JP)

( * ) Notice: Subject to any disclaimer, the term of this patent is extended or adjusted under 35 U.S.C. 154(b) by 44 days.

(21) Appl. No.: 11/067,507

(22) Filed: Feb. 25, 2005

(65) Prior Publication Data

US 2005/0188962 A1 Sep. 1, 2005

(30) Foreign Application Priority Data

Feb. 26, 2004 (JP) ..... 2004-051674

(51) Int. Cl.
*F02M 33/02* (2006.01)
*F02M 33/04* (2006.01)

(52) U.S. Cl. ..... 123/518; 123/184.57

(58) Field of Classification Search ..... 123/516, 123/518, 519, 521, 198 E, 198 D, 184.47
See application file for complete search history.

(56) References Cited

U.S. PATENT DOCUMENTS

| | | | | |
|---|---|---|---|---|
| 3,678,663 | A * | 7/1972 | Hansen | 96/141 |
| 4,300,511 | A * | 11/1981 | Lang | 123/520 |
| 5,472,463 | A * | 12/1995 | Herman et al. | 55/319 |
| 5,912,368 | A * | 6/1999 | Satarino et al. | 55/320 |
| 6,505,610 | B2 * | 1/2003 | Everingham et al. | 123/516 |
| 6,637,415 | B2 * | 10/2003 | Yoshioka et al. | 123/518 |
| 6,835,237 | B2 * | 12/2004 | Ishida | 96/135 |
| 7,028,673 | B2 * | 4/2006 | Itou et al. | 123/516 |
| 2005/0000362 | A1 * | 1/2005 | Bause et al. | 96/134 |
| 2005/0235967 | A1 * | 10/2005 | Itou et al. | 123/518 |
| 2006/0054142 | A1 * | 3/2006 | Burke et al. | 123/518 |

FOREIGN PATENT DOCUMENTS

| | | |
|---|---|---|
| JP | 2001227421 | 8/2001 |
| JP | 2002332924 | 11/2002 |
| JP | 2003106225 | 4/2003 |

* cited by examiner

*Primary Examiner*—Mahmoud Gimie
(74) *Attorney, Agent, or Firm*—Patterson, Thuente, Skaar & Christensen, P.A.

(57) ABSTRACT

A fuel vapor adsorbing device (10, 60, 70, 70', 80) for adsorbing residual fuel vapors that remain in an intake conduit (1, 2, 3, 4) of an induction system of an internal combustion engine when the internal combustion engine is stopped may include an adsorbing member (40, 40') that is constructed to adsorb the residual fuel vapors and is disposed along an inner wall surface of the intake conduit. The adsorbing member is arranged and constructed to form a supplemental intake path (T, T', T'") between the adsorbing member and the inner wall surface of the intake conduit, so that intake air of the engine can flow through the supplemental intake path.

8 Claims, 7 Drawing Sheets

FUEL VAPOR ADSORBING DEVICES

BACKGROUND OF THE INVENTION

1. Field of the Invention

The present invention relates to fuel vapor adsorbing devices for adsorbing residual fuel vapors that remain in an intake conduit of an induction system of an internal combustion engine during the stopping of the internal combustion engine.

2. Description of the Related Art

For example, Japanese Laid-open Patent Publication Number 2001-227421 teaches a fuel vapor adsorbing device for preventing outside leakage of residual fuel vapors that remain in an intake conduit of an induction system when an internal combustion engine is stopped. In this device, adsorbing materials are disposed in the intake conduit for adsorbing the fuel vapors.

As shown in FIG. 11, in a known device, the adsorbing materials 90 are entirely and evenly attached to an inner wall surface of a surge tank 94 that constitutes the intake conduit 92 of the induction system.

However, in the known device in which the adsorbing materials 90 are attached or adhered to the inner wall surface of the surge tank 94, only certain areas (i.e., non-adhering areas) of the outer surfaces of the adsorbing materials 90 are exposed. Therefore, the adsorbing materials 90 can only adsorb the fuel vapors in the exposed areas of the outer surfaces thereof. In other words, the adsorbing materials 90 cannot adsorb the fuel vapors in the remaining areas or non-exposed areas (i.e., adhering areas) of the outer surfaces thereof. As a result, the adsorbing materials 90 have limited effective adsorbing areas. Conversely, during operation of the internal combustion engine, the fuel vapors adsorbed to the adsorbing materials 90 will be purged or released therefrom by means of intake air. However, such adsorbed fuel vapors can also only be released from the exposed areas of the adsorbing material outer surfaces. That is, the adsorbed fuel vapors cannot be released from the non-exposed areas of the adsorbing material outer surfaces. As a result, the adsorbing materials 90 have limited effective releasing areas. Thus, the adsorbing materials 90 have a poor availability or utilization.

SUMMARY OF THE INVENTION

It is one object of the present invention to provide improved fuel vapor adsorbing devices for an internal combustion engine.

For example, in one aspect of the present invention, a fuel vapor adsorbing device for adsorbing residual fuel vapors that remain in an intake conduit of an induction system of an internal combustion engine when the internal combustion engine is stopped may include an adsorbing member that is constructed to adsorb the residual fuel vapors and is disposed along an inner wall surface of the intake conduit. The adsorbing member is arranged and constructed to form a supplemental intake path between the adsorbing member and the inner wall surface of the intake conduit, so that intake air of the engine can flow through the supplemental intake path.

According to this fuel vapor adsorbing device, the residual fuel vapors can be adsorbed in both sides of the adsorbing member. Also, the fuel vapors adsorbed in the adsorbing member can be purged or released from both sides of the adsorbing member by the intake air. Thus, the fuel vapors can be adsorbed in and released from both sides of the adsorbing member. Therefore, the adsorbing member may have an increased availability or utilization.

Other objects, features and advantages of the present invention will be readily understood after reading the following detailed description together with the accompanying drawings and the claims.

DETAILED DESCRIPTION OF THE INVENTION

Representative examples of the present invention have been described in detail with reference to the attached drawings. This detailed description is merely intended to teach a person of skill in the art further details for practicing preferred aspects of the present invention and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present invention.

Detailed representative embodiments of the present invention will now be described in further detail with reference to FIGS. 1 to 10.

First Detailed Representative Embodiment

A first detailed representative embodiment will now be described with reference to FIGS. 1 to 4(D).

A fuel vapor adsorbing device 10 of this embodiment is intended to be used in an internal combustion engine (not shown) (which will be simply referred to as "engine"), so as to adsorb residual fuel vapors that remain in an intake conduit of an induction system when the engine is stopped, thereby preventing outside leakage of such residual fuel vapors.

Figure 1:
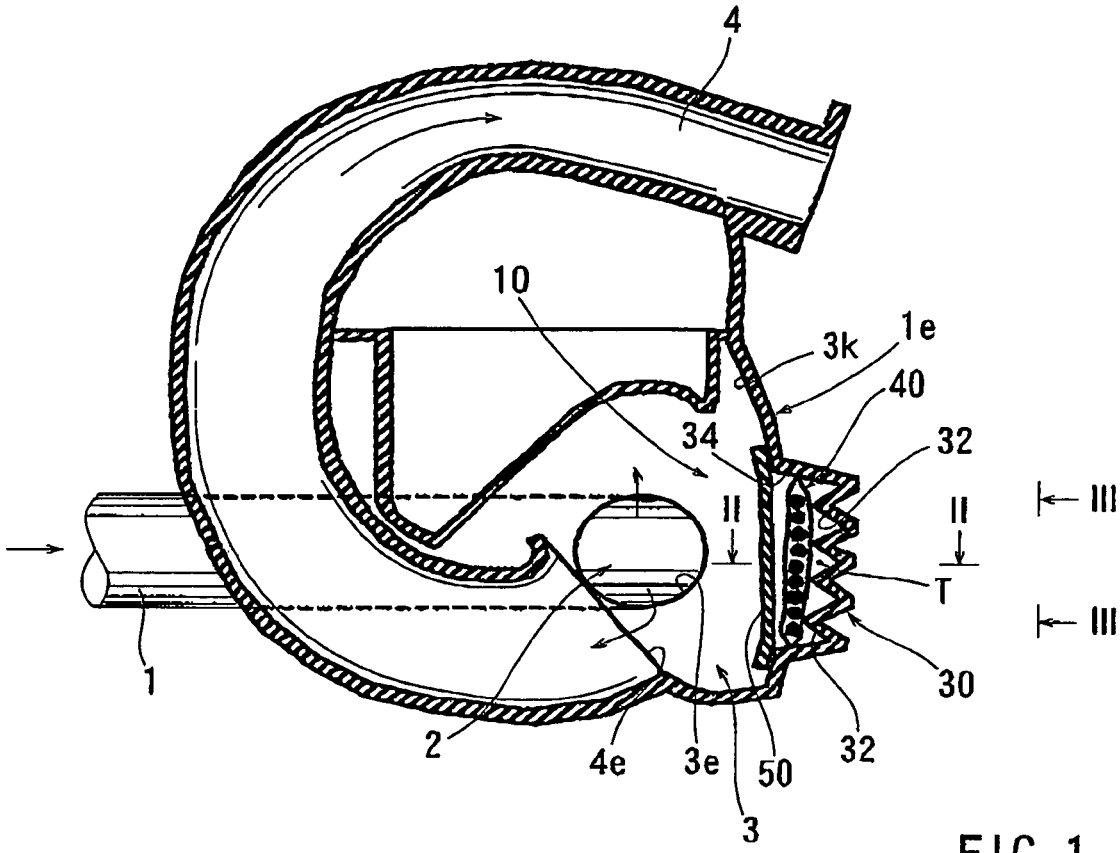
FIG. 1 is a vertical, cross-sectional view of an intake conduit of an induction system having a fuel vapor adsorbing device according to a first embodiment of the present invention.

As shown in FIG. 1, the induction system may includes an air cleaner (not show), an intake pipe 1 that is positioned downstream of the air cleaner, a throttle control device 2 that includes a throttle valve 2*v* (FIG. 3) for controlling intake air, and an induction unit 1*e* that is positioned downstream of the throttle control device 2. The induction unit 1*e* may include a surge tank 3 and a plurality of (e.g., four) intake manifolds 4 (one of which is shown), so that the intake air introduced into the surge tank 3 from the throttle control device 2 can be distributed to respective engine cylinders (not shown) through the intake manifolds 4. Further, it is noted that the intake pipe 1, the throttle control device 2, the surge tank 3 and the intake manifolds 4 correspond to the intake conduit in the present invention.

Figure 3:
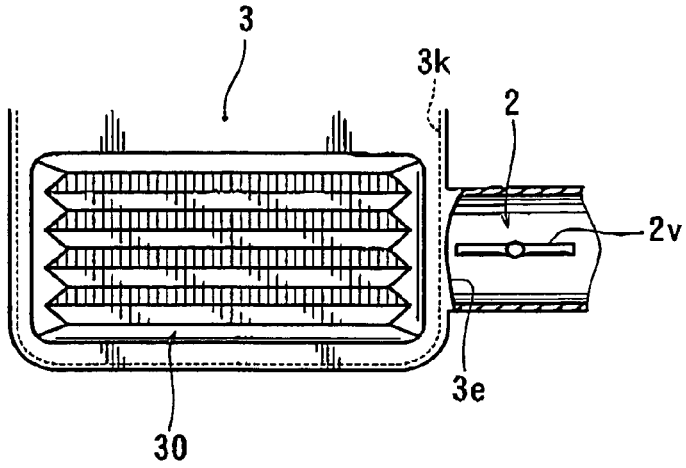
FIG. 3 is a side view of a surge tank, which is viewed along line III—III in FIG. 1.
Figure 4:
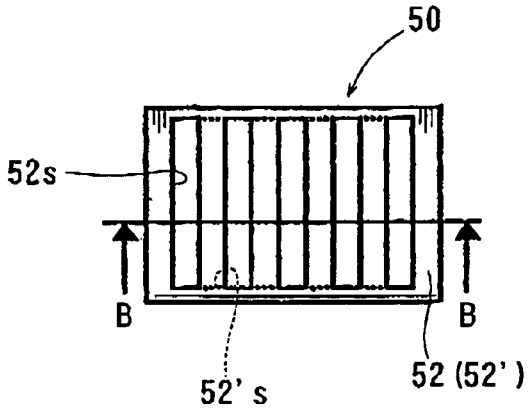
FIG. 4(A) is an elevational view of a gas shield member that is used in the fuel vapor adsorbing device.
FIG. 4(B) is a cross-sectional view taken along line B—B in FIG. 4(A)
FIG. 4(C) is an elevational view of a modified gas shield member that is used in the fuel vapor adsorbing device.
FIG. 4(D) is a cross-sectional view taken along line D—D in FIG. 4(C)
Figure 4:
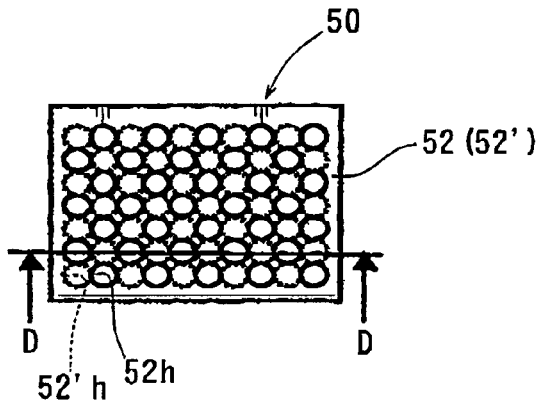
Figure 4:
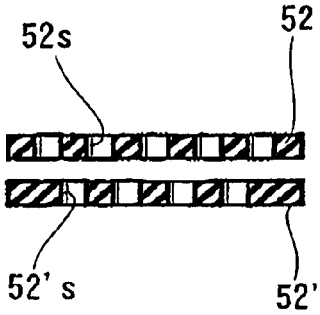
Figure 4:
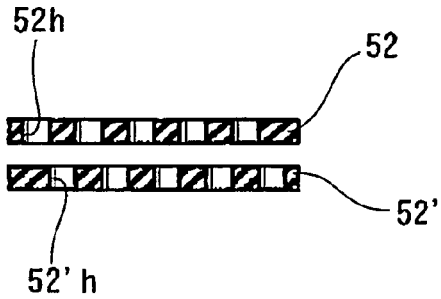

As best shown in FIG. 3, the surge tank 3 of the induction unit 1*e* has an inlet port 3*e* that is connected to the throttle control device 2, so that the intake air is introduced into the surge tank 3 from the throttle control device 2 via the inlet port 3*e*. The intake air introduced into the surge tank 3 may flow along an inner wall surface 3*k* of the surge tank 3 in a direction from right to left in FIG. 3 (a direction away from the plane in FIG. 1), so as to be distributed to the respective engine cylinders (not shown) through the intake manifolds 4.

As shown in FIG. 1, a rectangular recessed portion 30 having an opening 34 is formed in a vertical portion of the inner wall surface 3*k* of the surge tank 3 in order to receive an adsorbing member 40 (which will be hereinafter described). Preferably, the recessed portion 30 may have a depth greater than the thickness of the adsorbing member 40. The recessed portion 30 is positioned so as to be opposite to inlet ports 4*e* of the intake manifolds 4. As shown in FIG. 3, the recessed portion 30 has a laterally elongated rectangular shape. Also, the recessed portion 30 has a corrugated bottom wall (i.e., a grooved wall portion) that has a plurality of laterally extending straight grooves 32 having a triangular shape in cross section. Therefore, as shown in FIG. 1, a plurality of laterally extending passages T are formed between the adsorbing member 40 and the bottom wall of the recessed portion 30 when the adsorbing member 40 is received in the recessed portion 30. As will be recognized, the grooves 32 may preferably be arranged such that the passages T extend along a flow direction of the intake air. Further, it is noted that the passages T corresponds to a supplemental intake path in the present invention, which constitute the fuel vapor adsorbing device 10.

Typically, the adsorbing member 40 may preferably be formed as a flattened member having a substantially rectangular shape that corresponds to the shape of the recessed portion 30 of the surge tank 3. The adsorbing member 40 may preferably be constructed from an adsorbing element 44 that can adsorb the fuel vapors, and a rectangular gas-permeable nonwoven fabric bag 42 (i.e., a covering member) that receives the adsorbing element 44. The adsorbing element 44 may preferably be made from granular or pelletized materials such as activated carbon, zeolite, silica gel or other such materials. In addition, the nonwoven fabric bag 42 may preferably be made from aramid fibers or other such heat resistant fibers, so as to endure high temperatures due to an engine backfiring or other such phenomena. As will be recognized, the adsorbing member 40 constitutes the fuel vapor adsorbing device 10.

Optionally, the adsorbing member 40 can be constructed from only the adsorbing element 44 while omitting the fabric bag 42. For example, the adsorbing element 44 can be formed as a sheet-like member (not shown) having a rectangular shape that corresponds to the shape of the recessed portion 30. In such a case, the adsorbing element 44 may preferably be made from fibrous materials.

The adsorbing member 40 thus constructed is received in the recessed portions 30. The opening 34 of the recessed portion 30 is respectively substantially coveted with a gas shield member 50 (i.e., a gas shield element) which may optionally constitute the fuel vapor adsorbing device 10. The gas shield member 50 may function to cover and protect the adsorbing member 40 (the adsorbing element 44) from being directly exposed to blow-by gases that are returned into the surge tank 3 during engine operation. The gas shield member 50 may preferably be positioned such that a clearance can be formed between the gas shield member 50 and the adsorbing member 40. As shown in FIGS. 4(A) and 4(B), the gas shield member 50 may preferably be constructed from two flat plates, i.e., a first plate 52 and a second plate 52', that are disposed in parallel with each other at a predetermined spacing. The first plate 52 is formed with a plurality of vertically elongated slots 52*s* (i.e., instreaming openings) that are laterally spaced at desired intervals. Similarly, the second plate 52' is formed with a plurality of vertically elongated slots 52'*s* (i.e., instreaming openings) that are laterally spaced at desired intervals. The slots 52'*s* may preferably have the same widths and intervals as the slots 52*s*. However, the slots 52*s* and 52'*s* may be alternately positioned each other in a lateral direction in FIG. 4(A). In other words, the slots 52*s* of the first plate 52 and the slots 52'*s* of the second plate 52' may preferably be arranged so as to not align with each other along a direction corresponding to the thickness of the plates 52 and 52' (i.e., a vertical direction in FIG. 4(B)), so that only indirect pathways exist for the gas along the direction of thickness.

Further, the first and second plates 52 and 52' can be modified, if necessary. For example, as shown in FIGS. 4(C) and 4(D), the first plate 52 can be formed with a plurality of apertures 52*h* (i.e., instreaming openings) that are spaced vertically and laterally at desired intervals. Similarly, the second plate 52' can be formed with a plurality of apertures 52'*h* (i.e., the instreaming openings) that are laterally spaced at desired intervals. In this case, the apertures 52'*h* may preferably have the same shapes, sizes and intervals as the apertures 52*h*. However, the apertures 52*h* and 52'*h* may be alternately positioned each other in lateral and vertical directions in FIG. 4(C). In other words, the apertures 52*h* of the first plate 52 and the apertures 52'*h* of the second plate 52' may preferably be arranged so as to not align with each other along a direction corresponding to the thickness of the plates 52 and 52' (i.e., a vertical direction in FIG. 4(D)), so that only indirect pathways exist for the gas along the direction of thickness.

Figure 2:
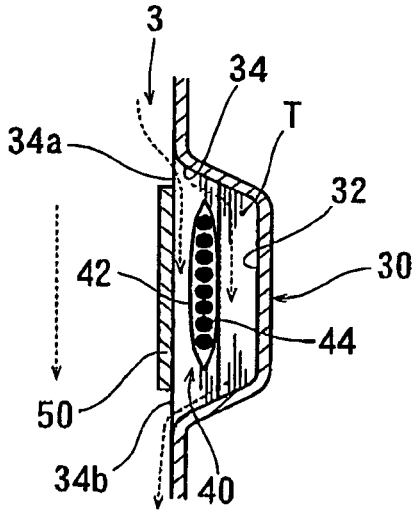
FIG. 2 is a cross-sectional view taken along line II—II in FIG. 1.

As shown in FIGS. 1 and 2, the gas shield member 50 may preferably have a width (i.e., a vertical size) greater than the width of the opening 34 of the recessed portion 30 and a length (i.e., a lateral size) smaller than the length of the opening 34. Therefore, lateral end portions (i.e., upper and lower end portions in FIG. 2) of the opening 34 of the recessed portion 30 are not covered with the gas shield member 50, so as to provide a pair of thin openings, i.e., an upstream opening 34*a* and a downstream opening 34*b*, in the recessed portion 30. In addition, the gas shield member 50 may preferably have substantially the same length as the adsorbing member 40, so as to substantially conceal the adsorbing member 40 received in the recessed portion 30.

Operation of the fuel vapor adsorbing device 10 detailed according to this embodiment will now be described.

During the stopping of the engine, the residual fuel vapors that remain in the intake manifolds 4 of the induction system can be naturally introduced into the surge tank 3. One portion of such fuel vapors flows into the recessed portion 30 through the slots 52*s* and 52'*s* (the apertures 52*h* and 52'*h*) of the gas shield member 50 and are adsorbed in an obverse side of the adsorbing member 40. Also, the other portion of the residual fuel vapors flows into the recessed portion 30 through the upstream opening 34*a* and the downstream opening 34*b*. A portion of the residual fuel vapors introduced into the recessed portion 30 is adsorbed in the obverse side of the adsorbing member 40. Further, a remaining portion of the residual fuel vapors introduced into the recessed portion 30 flows through the plurality of passages T formed between the adsorbing member 40 and the bottom wall of the recessed portion 30 and is adsorbed in a reverse side of the adsorbing member 40.

Thus, the fuel vapors can be effectively adsorbed in both of the obverse and reverse sides of the adsorbing member 40. Therefore, the adsorbing member 40 (specifically the adsorbing element 44) may have an increased adsorbing efficiency.

During operation of the engine, the intake air introduced into the intake pipe 1 via the air cleaner enters the surge tank 3 of the induction unit 1*e* via the throttle control device 2. One portion of the intake air introduced into the surge tank 3 flows along the inner wall surface 3*k* of the surge tank 3 and enters the recessed portion 30 through the upstream opening 34*a*. A portion of the intake air introduced into the recessed portion 30 flows along the obverse side of the adsorbing member 40, and a remaining portion thereof flows through the plurality of passages T along the reverse side of adsorbing member 40. Also, the other portion of the intake air introduced into the surge tank 3 flows into the recessed portion 30 through the slots 52*s* and 52'*s* (the apertures 52*h* and 52'*h*) of the gas shield member 50 and flows along the obverse side of the adsorbing member 40. As a result, the residual fuel vapors adsorbed in the adsorbing member 40 can be purged or released from the obverse and reverse sides of the adsorbing member 40 by the intake air introduced into the recessed portion 30 and be subsequently entrapped into the intake air.

The fuel vapor containing intake air that has flowed along the obverse and reverse sides of the adsorbing member 40 received in the recessed portion 30 may flow out through the downstream opening 34*b*, and then be fed into the respective engine cylinders through the intake manifolds 4.

Further, during operation of the engine, the blow-by gases may be returned into the surge tank 3. The returned blow-by gases may be introduced into the engine cylinders together with the intake air and then be re-combusted in the engine.

Typically, the blow-by gases are blown over the gas shield member 50 when the blow-by gases are returned into the surge tank 3. However, the returned blow-by gases may flow by snaking through the slots 52*s* and 52'*s* (the apertures 52*h* and 52'*h*) of the first and second plates 52 and 52' and then contact the adsorbing member 40 because the slots 52*s* and 52'*s* (the apertures 52*h* and 52'*h*) are specially arranged as previously described. That is, the returned blow-by gases passing through the slots 52*s* (the apertures 52*h*) of the first plate 52 contact the second plate 52', and then flow through the slots 52'*s* (the apertures 52'*h*) of the second plate 52' toward the adsorbing member 40. When the returned blow-by gases contact the second plate 52', oil mists or other such components contained therein can be adhered to the second plate 52' and be liquefied thereon. Therefore, the returned blow-by gases may contact the adsorbing member 40 after the oil mists or other such components have been substantially removed therefrom. As a result, the adsorbing member 40 (specifically the adsorbing element 44) may be effectively prevented from being contaminated by the oil mists or other such components contained in the returned blow-by gases.

According to the fuel vapor adsorbing device 10 of this embodiment, the passages T are formed in the recessed portion 30. Therefore, the fuel vapors can be adsorbed and released in both of the obverse and reverse sides of the adsorbing member 40. Therefore, the adsorbing member 40 (specifically the adsorbing element 44) may have an increased availability or utilization.

Also, the adsorbing member 40 is covered with the gas shield member 50. Therefore, the adsorbing member 40 can be effectively prevented from being directly exposed to the returned blow-by gases. This may lead to retardation of the degradation of the adsorbing element 44.

Further, the passages T extend along the flow direction of the intake air. Therefore, the intake air can smoothly flow through the passages T so that turbulence of the intake air can be effectively avoided. As a result, the adsorbed fuel vapors can be effectively released from the adsorbing member 40.

Second Detailed Representative Embodiment

Figure 5:
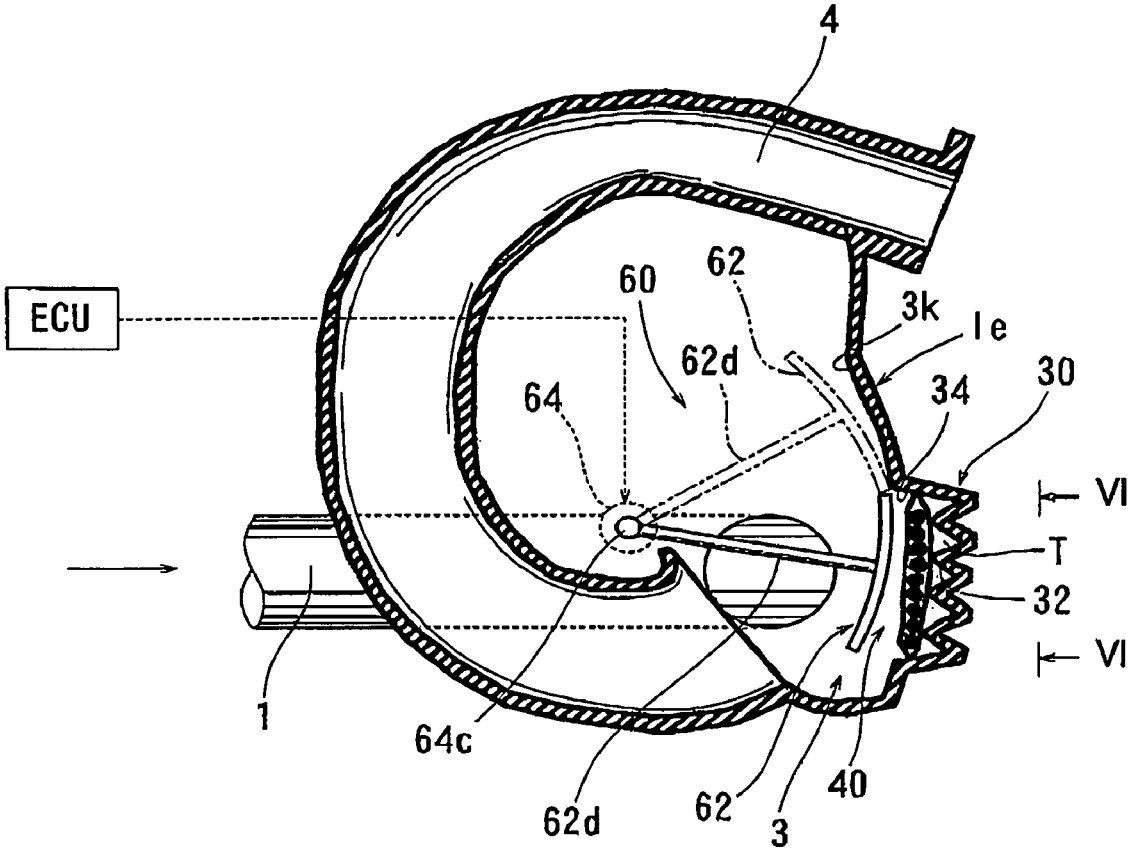
FIG. 5 is a vertical, cross-sectional view of the intake conduit of the induction system having a fuel vapor adsorbing device according to a second embodiment of the present invention.
Figure 6:
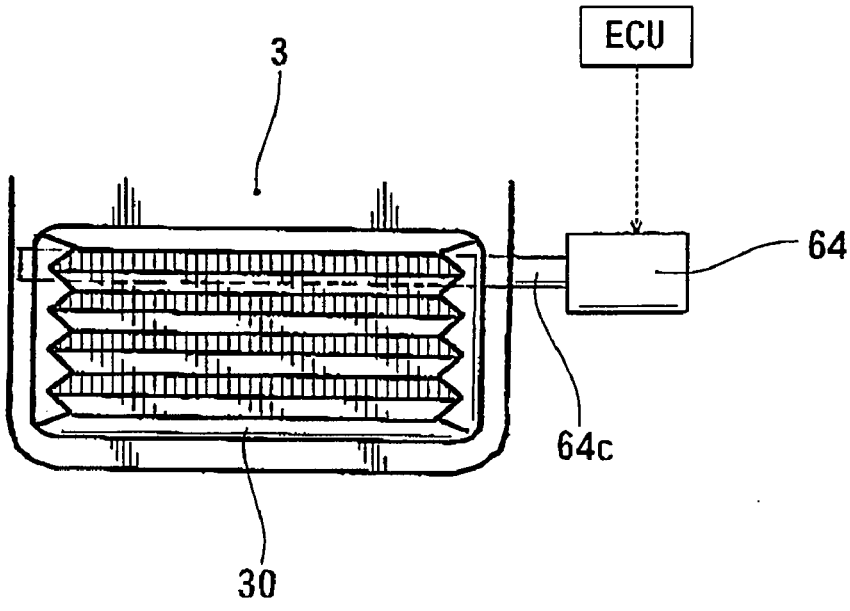
FIG. 6 is a side view of a surge tank, which is viewed along line VI—VI in FIG. 5.

A second detailed representative embodiment will now be described with reference to FIGS. 5 and 6. Because the second embodiment relates to the first embodiment, only constructions and elements that are different from the first embodiment will be explained in detail. Elements that are the same as in the first embodiment will be identified by the same reference numerals and a detailed description of such elements will be omitted.

A fuel vapor adsorbing device 60 of this embodiment includes a gas shield member 62 (i.e., the gas shield element) which corresponds to the gas shield member 50 in the first embodiment. Similar to the first embodiment, the gas shield member 62 may function to protect the adsorbing member 40 from being directly exposed to the blow-by gases that are returned into the surge tank 3 during engine operation. Unlike the first embodiment, the gas shield member 62 may preferably be constructed from a single plate having a desired shape in a vertical cross section, e.g., an arcuate shape in vertical cross section (FIG. 5). The gas shield member 62 is provided with a support arm 62*d*. The support arm 62*d* is connected to a rotational shaft 64*c* of a motor 64. As best shown in FIG. 6, the motor 64 is disposed outside the surge tank 3, and the rotational shaft 64*c* thereof is rotatably inserted into the surge tank 3. Further, the motor 64 is arranged such that the rotational shaft 64*c* may be essentially parallel to the straight grooves 32 (or the passages T). Therefore, when the motor 64 is actuated, the support arm 62*d* is rotated clockwise and counterclockwise in FIG. 5 so that the gas shield member 62 can move vertically along the inner wall surface 3*k* of the surge tank 3 between a covering position shown by a solid line in FIG. 5 and an uncovering position shown by a broken line in FIG. 5. As will be apparent, in the covering position, the gas shield member 62 may substantially cover the opening 34 of the recessed portion 30 so that the adsorbing member 40 is substantially concealed. Conversely, in the uncovering position, the gas shield member 62 may substantially entirely uncover or fully open the opening 34 of the recessed portion 30 so that the adsorbing member 40 is substantially exposed.

In addition, the motor 64 may preferably be connected to an electric control unit (ECU) so that the rotational angle of the motor 64 can be appropriately controlled depending upon an engine rotating speed. The ECU may preferably be set such that the motor 64 is rotated clockwise in FIG. 5 when the engine rotational speed is increased and that the motor 64 is rotated counterclockwise in FIG. 5 when the engine rotational speeds are decreased. In other words, the ECU may preferably be set such that the gas shield member 62 moves toward the covering position when the engine rotational speed is increased and that the gas shield member 62 moves toward the uncovering position when the engine rotational speed is decreased.

Further, it is noted that the motor 64, the rotational shaft 64*c*, the support arm 62*d* and the ECU will be referred to as a gas shield member moving mechanism in the present invention.

Generally, when the engine rotational speed is increased during operation of the engine, the blow-by gases may be increased. However, according to the fuel vapor adsorbing device 60 of this embodiment, the adsorbing member 40 can be gradually concealed by the gas shield member 62 as the engine rotational speed is increased. Therefore, even if the blow-by gases are increased, the adsorbing member 40 (specifically the adsorbing element 44) can be effectively prevented from being contaminated by the oil mists or other such components contained in the blow-by gases. Conversely, when the engine rotational speed decreases, the blow-by gases are decreased. In this condition, the adsorbing member 40 can be exposed as a result of the counterclockwise rotation of the gas shield member 62. Therefore, the adsorbed fuel vapors can be reliably released from the adsorbing member 40 by the intake air without failing a desired releasing efficiency. Naturally, during the stopping of the engine, the adsorbing member 40 can be fully exposed. Therefore, the residual fuel vapors introduced into the recessed portion 30 can be sufficiently adsorbed in the adsorbing member 40.

The ECU can be modified, if necessary. For example, the ECU can be set such that the motor 64 is rotated clockwise depending upon a rate of change of the engine rotational speed and not the engine rotational speed. Also, the gas shield member moving mechanism can be modified. For example, the gas shield member moving mechanism can be constructed such that the gas shield member 62 can be moved counterclockwise by means of a spring (not shown) and not the motor 64 when the engine rotational speed is decreased.

Third Detailed Representative Embodiment

A third detailed representative embodiment will now be described with reference to FIG. 7. Because the third embodiment relates to the first embodiment, only constructions and elements that are different from the first embodiment will be explained in detail. Elements that are the same as in the first embodiment will be identified by the same reference numerals and a detailed description of such elements will be omitted.

Figure 7:
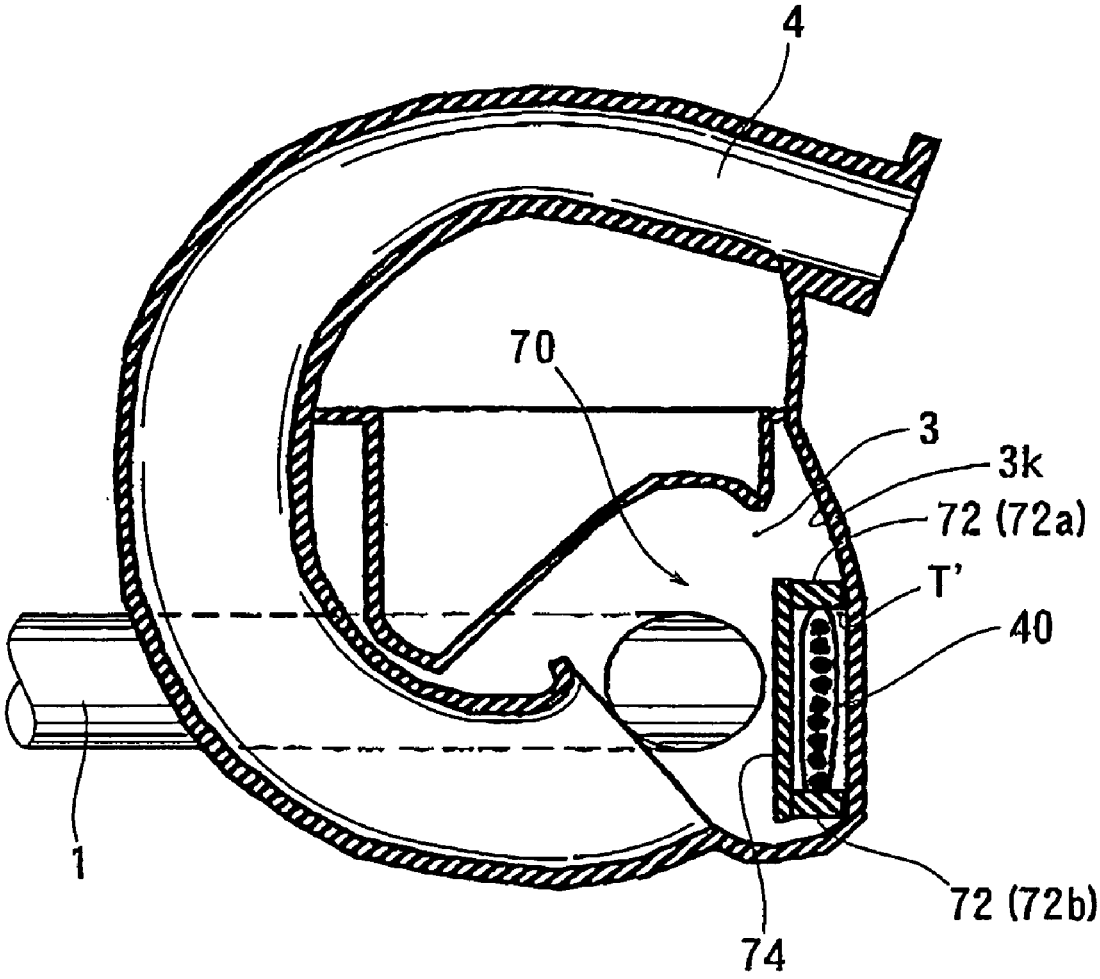
FIG. 7 is a vertical, cross-sectional view of the intake conduit of the induction system having a fuel vapor adsorbing device according to a third embodiment of the present invention.

As shown in FIG. 7, in this embodiment, the inner wall surface 3*k* of the surge tank 3 is not formed with a recessed portion that corresponds to the rectangular recessed portion 30 in the first embodiment. Instead, a support member 72 is attached to the inner wall surface 3*k* of the surge tank 3. The support member 72 is constructed from two elongated plates, i.e., a first support plate 72*a* and a second support plate 72*b*. These support plates 72*a* and 72*b* are disposed along a lateral direction (i.e., a direction perpendicular to the plane in FIG. 7). Further, these plates 72*a* and 72*b* are vertically oppositely disposed in parallel with each other at a predetermined interval, so as to form an adsorbing member receiving channel therebetween that laterally extends along the inner wall surface 3*k* of the surge tank 3. Preferably, each of these support plates 72*a* and 72*b* may have a width greater than the thickness of the adsorbing member 40.

The adsorbing member 40 is positioned between the first and second plates 72*a* and 72*b* (i.e., within the adsorbing member receiving channel) while leaving a clearance between the adsorbing member 40 and the inner wall surface 3*k* of the surge tank 3. Preferably, the adsorbing member 40 is positioned at a substantially central portion of the adsorbing member receiving channel. Upper and lower peripheries of the adsorbing member 40 thus positioned are respectively connected to the upper plate 72*a* and the lower plate 72*b* so that a laterally extending passage T' (i.e., the supplemental intake path) is defined by the adsorbing member 40, the inner wall surface 3*k*, and the support member 72. As will be recognized, the passage T' is opened at lateral ends.

A fuel vapor adsorbing device 70 of this embodiment includes a gas shield member 74 (i.e., the gas shield element). The gas shield member 74 is attached to the support member 72 so as to cover the adsorbing member 40 received within the adsorbing member receiving channel. The gas shield member 74 may preferably be positioned such that a clearance can be formed between the gas shield member 74 and the adsorbing member 40. The gas shield member 74 may preferably have the same construction as the gas shield member 50 in the first embodiment.

In this embodiment, it is not necessary to form the recessed portion in the surge tank 3. Therefore, this embodiment is useful in a case where it is structurally difficult to form a recessed portion in the surge tank 3.

Fourth Detailed Representative Embodiment

A fourth detailed representative embodiment will now be described with reference to FIGS. 8 and 9. Because the fourth embodiment relates to the third embodiment, only constructions and elements that are different from the third embodiment will be explained in detail, Elements that are the same as in the third embodiment will be identified by the same reference numerals and a detailed description of such elements will be omitted.

Figure 8:
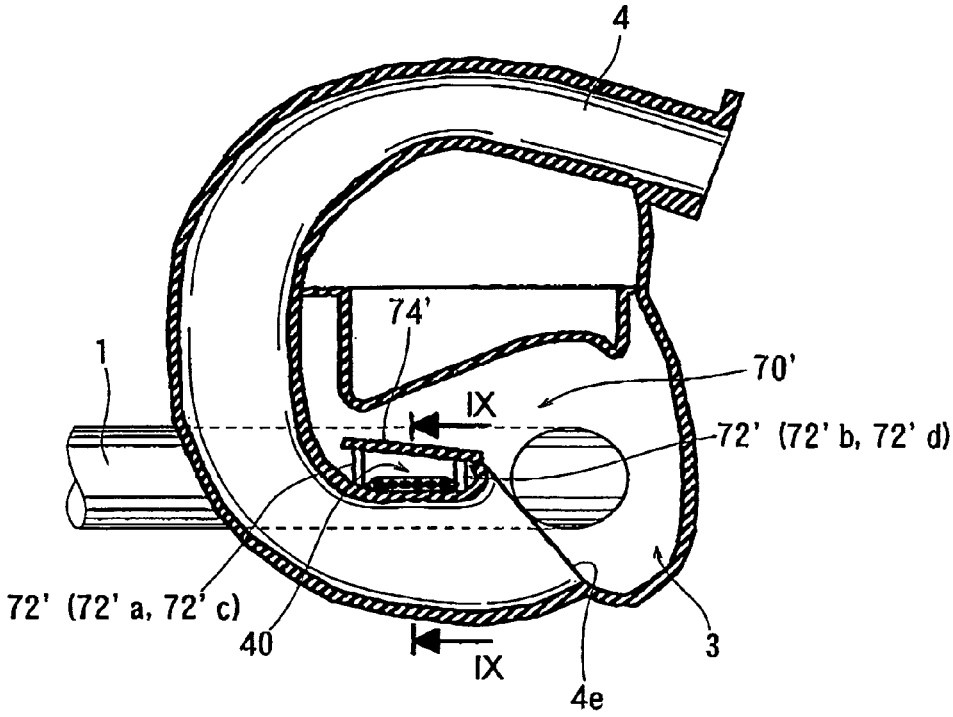
FIG. 8 is a vertical, cross-sectional view of the intake conduit of the induction system having a fuel vapor adsorbing device according to a fourth embodiment of the present invention.
Figure 9:
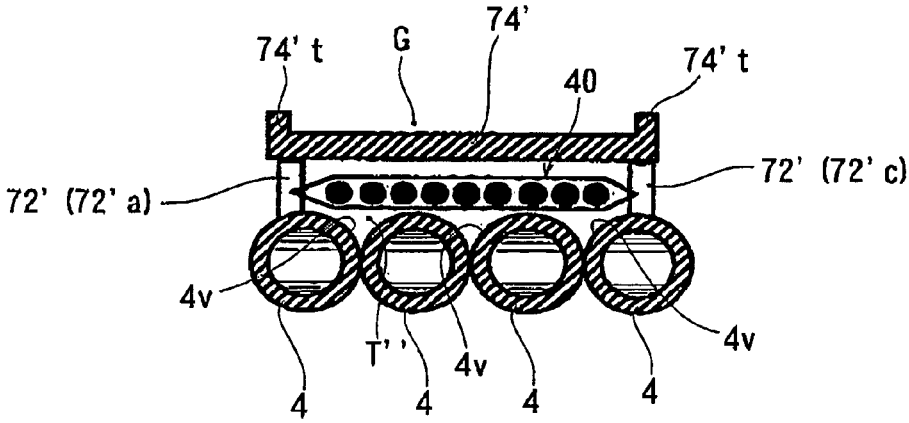
FIG. 9 is a cross-sectional view taken along line IX—IX in FIG. 8.
Figure 10:
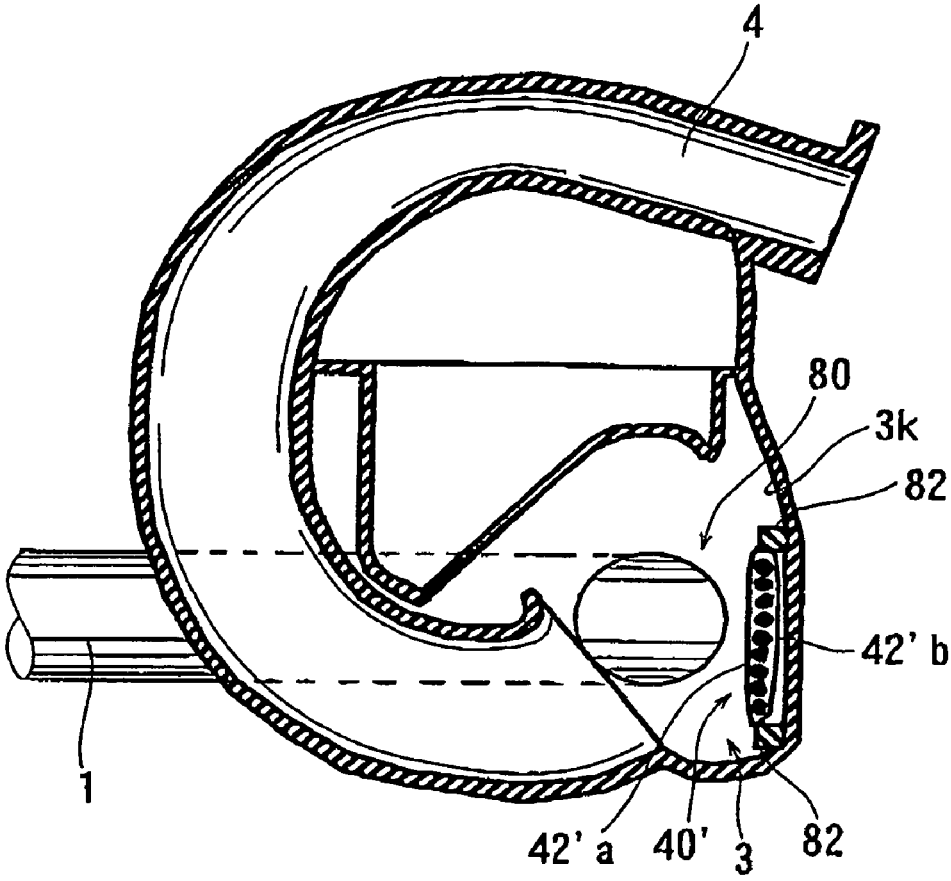
FIG. 10(A) is a vertical, cross-sectional view of the intake conduit of the induction system having a fuel vapor adsorbing device according to a fifth embodiment of the present invention.
FIG. 10(B) is an explanatory cross-sectional view of an adsorbing member.
Figure 10:
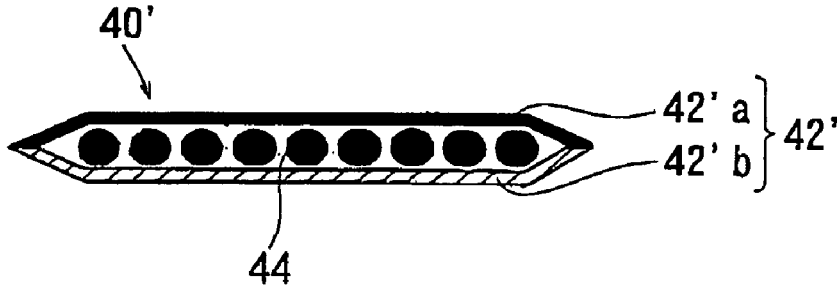
Figure 11:
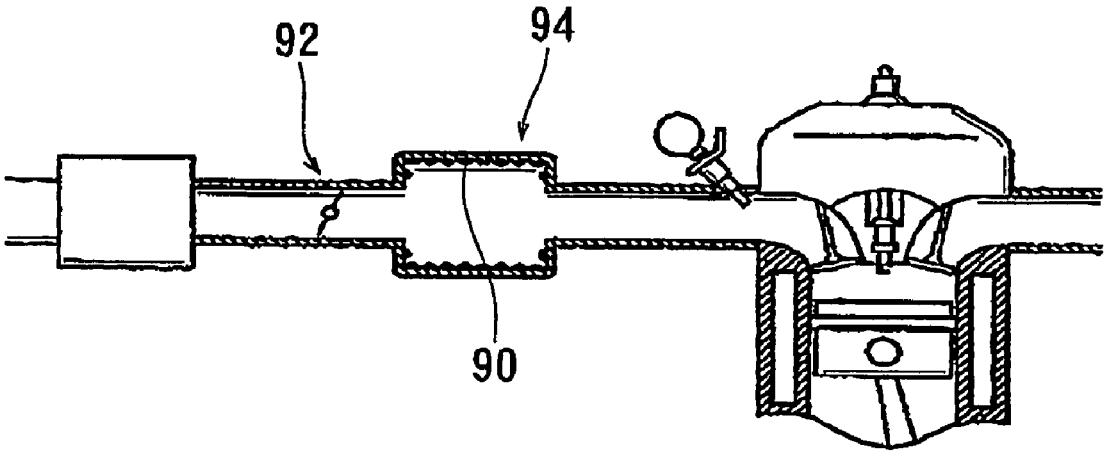
FIG. 11 PRIOR ART
FIG. 11 is a partly explanatory cross-sectional view of an internal combustion engine having a conventional fuel vapor adsorbing device.

As shown in FIGS. 8 and 9, in this embodiment a support member 72' is disposed on and attached to the intake manifolds 4. The support member 72' is constructed from four pillars, i.e., a first to fourth pillars 72'*a*–72'*d*. Further, as shown in FIG. 8, the first and third pillars 72'*a* and 72'*c* (i.e., rear pillars) that are leftwardly positioned have a length longer than the length of the second and fourth pillars 72'*b* and 72'*d* (i.e., front pillars) that are rightwardly positioned. These support pillars 72'*a*–72'*d* are appropriately arranged so as to define an adsorbing member receiving space on the intake manifolds 4. Preferably, each of these pillars 72'*a*–72'*d* may have a length greater than the thickness of the adsorbing member 40.

The adsorbing member 40 is disposed on the intake manifolds 4 so as to be received within the adsorbing member receiving space. As shown in FIG. 9, the intake manifolds 4 may inherently define a plurality of wedge shaped grooves 4*v* therebetween (e.g., three are shown in this embodiment). Therefore, a plurality of passages T" (i.e., the supplemental intake path) are automatically formed between the adsorbing member 40 and the intake manifolds 4. As will be apparent, the passages T" extend along the intake manifolds 4.

A fuel vapor adsorbing device 70' of this embodiment includes a gas shield member 74' (i.e., the gas shield element). The gas shield member 74' is disposed on and attached to the support member 72' so as to cover the adsorbing member 40 received within the adsorbing member receiving space. The gas shield member 74' may preferably be positioned such that a clearance can be formed between the gas shield member 74' and the adsorbing member 40. As shown in FIG. 8, the gas shield member 74' is inclined downwardly and forwardly along the intake manifolds 4 because the first and third pillars 72'*a* and 72'*c* are longer than the second and fourth pillars 72'*b* and 72'*d*. That is, the gas shield member 74' is inclined downwardly toward the inlet ports 4*e* of the intake manifolds 4. Further, unlike the third embodiment, the gas shield member 74' may preferably be constructed from a single plate similar to the gas shield member 62 in the second embodiment. As shown in FIG. 9, the gas shield member 74' may include a pair of upwardly projected side flanges 74'*t* that extend along lateral peripheries thereof. The side flanges 74'*t* thus formed define a guide channel G on the gas shield member 74'. As will be apparent, the guide channel G is inclined downwardly and forwardly along the intake manifolds 4.

In this embodiment, when the returned blow-by gases contact the gas shield member 74', the oil mists or other such components contained therein may be liquefied thereon and flow down along the inclined guide groove G toward the inlet ports 4*e* of the intake manifolds 4 as a result of gravity. Therefore, the adsorbing member 40 (specifically the adsorbing element 44) may be effectively prevented from being contaminated by the oil mists or other such components contained in the returned blow-by gases.

Fifth Detailed Representative Embodiment

A fifth detailed representative embodiment will now described with reference to FIGS. 10(A) and 10(B). Because the fifth embodiment relates to the third embodiment, only constructions and elements that are different from the third embodiment will be explained in detail. Elements that are the same as in the third embodiment will be identified by the same reference numerals and a detailed description of such elements will be omitted.

As shown in FIGS. 10(A) and 10(B), in this embodiment a support member 82, similar to the support member 72 in the third embodiment, is attached to the inner wall surface 3*k* of the surge tank 3.

A fuel vapor adsorbing device 80 of this embodiment includes an adsorbing member 40' that is modified from the adsorbing member 40 used in the previous embodiments. The adsorbing member 40' includes a partly gas-permeable nonwoven fabric bag 42' (i.e., the covering member) that is modified from the nonwoven fabric bag 42 in the previous embodiments. As best shown in FIG. 10(B), the fabric bag 42' is made from a gas-impermeable fabric portion 42'*a* (i.e., the gas shield element) and a gas-permeable fabric portion 42'*b*. As shown in FIG. 10(A), the adsorbing member 40' having the fabric bag 42' thus constructed is attached to the support member 82 such that the gas-impermeable fabric portion 42'*a* of the fabric bag 42' faces the inlet ports 4*e* of the intake manifolds 4 (i.e., such that the gas-permeable fabric portion 42'*b* of the fabric bag 42' faces the inner wall surface 3*k* of the surge tank 3).

As shown in FIG. 10(A), the fuel vapor adsorbing device 80 does not include a separate gas shield member that corresponds to the gas shield member 74 in the third embodiment. Therefore, in this embodiment, the adsorbing member 40' may be directly exposed to the blow-by gases that are returned into the surge tank 3 during the engine operation. However, the oil mists or other such components contained in the returned blow-by gases can be effectively prevented from entering the adsorbing member 40' by means of the gas-impermeable fabric portion 42'*a*. Therefore, the adsorbing element 44 of the adsorbing member 40' may be effectively prevented from being contaminated by the oil mists or other such components. Therefore, similar to the previous embodiments, the degradation of the adsorbing element 44 can be effectively retarded.

According to this embodiment, a separate gas shield member is not required. Therefore, costs for manufacturing the fuel vapor adsorbing device 80 can be reduced.

Various changes and modifications may be made to the representative embodiments without departing from the scope of the present invention. For example, in the first and second embodiments, the bottom wall of the recessed portion 30 is formed with the straight grooves 32, thereby forming the passages T in the recessed portion 30. However, an inner side (i.e., a side that faces the bottom wall of the recessed portion 30) of the adsorbing member 40 can be formed with straight grooves (not shown) instead of forming the grooves 32 in the recessed portion 32, thereby forming the passages T between the adsorbing member 40 and the recessed portion 30.

Further, in the fourth embodiment, the gas shield member 74' is formed with the upwardly projected side flanges 74'*t*, thereby defining the guide channel G thereon. However, instead of forming the side flanges 74'*t* in the gas shield member 74', the gas shield member 74' can be formed from a corrugated plate (not shown) inherently having a plurality of grooves so as to utilize such grooves as guide channels.

The invention claimed is:

1. A fuel vapor adsorbing device for adsorbing residual fuel vapors that remain in an intake conduit of an induction system of an internal combustion engine when the internal combustion engine is stopped, comprising:

an adsorbing member that is constructed to adsorb the residual fuel vapors and is disposed along an inner wall surface of the intake conduit; and a gas shield member that is arranged and constructed to prevent the adsorbing member from being directly exposed to blow-by gases that are returned into the intake conduit during engine operation, wherein the adsorbing member is arranged and constructed to form a supplemental intake path between the adsorbing member and the inner wall surface of the intake conduit, so that intake air of the engine can flow through the supplemental intake path, and wherein the gas shield member is constructed from first and second plates that are disposed at a predetermined spacing, each of the first and second plates having a plurality of instreaming openings, and wherein the instreaming openings of the first and second plates are arranged so as not to align with each other along a direction corresponding to the thickness of the first and second plates.

2. A fuel vapor adsorbing device for adsorbing residual fuel vapors that remain in an intake conduit of an induction system of an internal combustion engine when the internal combustion engine is stopped, comprising:

an adsorbing member that is constructed to adsorb the residual fuel vapors and is disposed along an inner wall surface of the intake conduit;

a gas shield member that is arranged and constructed to prevent the adsorbing member from being directly exposed to blow-by gases that are returned into the intake conduit during engine operation; and a gas shield member moving mechanism that is arranged and constructed to move the gas shield member in response to engine speed, wherein the adsorbing member is arranged and constructed to form a supplemental intake path between the adsorbing member and the inner wall surface of the intake conduit, so that intake air of the engine can flow through the supplemental intake path.

3. A fuel vapor adsorbing device for adsorbing residual fuel vapors that remain in an intake conduit of an induction system of an internal combustion engine when the internal combustion engine is stopped, comprising:

an adsorbing member that is constructed to adsorb the residual fuel vapors and is disposed along an inner wall surface of the intake conduit, wherein the adsorbing member is arranged and constructed to form a supplemental intake path between the adsorbing member and the inner wall surface of the intake conduit, so that intake air of the engine can flow through the supplemental intake path, wherein the adsorbing member comprises a covering member, wherein the covering member comprises a first portion that is made from a gas-impermeable material and a second portion tat is made from a gas-permeable material, and wherein the adsorbing member is disposed such that the first portion of the covering member faces the intake conduit.

4. The fuel vapor adsorbing device as defined in claim 3, wherein the supplemental intake path is arranged and constructed to extend along the direction of the intake air.

5. A fuel vapor adsorbing device for adsorbing residual fuel vapors that remain in an intake conduit of an induction system of an internal combustion engine when the internal combustion engine is stopped, comprising:

an adsorbing member that is constructed to adsorb the residual fuel vapors and is disposed along an inner wall surface of the intake conduit, wherein the adsorbing member is arranged and constructed to form a supplemental intake path between the adsorbing member and the inner wall surface of the intake conduit, so that intake air of the engine can flow through the supplemental intake path, wherein the inner wall surface of the intake conduit is formed with a recessed portion having a groove, and wherein the adsorbing member is received in the recessed portion, thereby forming the supplemental intake path between the adsorbing member and the recessed portion.

6. The fuel vapor adsorbing device as defined in claim 5, wherein the inner wall surface of the intake conduit is provided with a support member, and wherein the adsorbing member is attached to the support member such that the supplemental intake path is formed between the adsorbing member and the inner wall surface.

7. The fuel vapor adsorbing device as defined in claim 5, wherein the intake conduit comprises a surge tank of the induction system, and wherein the adsorbing member comprises an adsorbing element that is constructed to adsorb the residual fuel vapors and is disposed along an inner wall surface of the surge tank of the induction system, and further comprising a gas shield element that is arranged and constructed to prevent the adsorbing element from being directly exposed to blow-by gases that are returned into the surge tank during engine operation.

8. A fuel vapor adsorbing device for adsorbing residual fuel vapors that remain in an intake conduit of an induction system of an internal combustion engine when the internal combustion engine is stopped, comprising:

an adsorbing member that is constructed to adsorb the residual fuel vapors and is disposed alone an inner wall surface of the intake conduit, wherein the adsorbing member is arranged and constructed to form a supplemental intake path between the adsorbing member and the inner wall surface of the intake conduit, so that intake air of the engine can flow through the supplemental intake path, wherein the intake conduit includes a plurality of intake manifolds that define a plurality of grooves therebetween, and wherein the adsorbing member is disposed on the intake manifolds, thereby forming the supplemental intake path between the adsorbing member and the intake manifolds.

* * * * *